US010426298B2

(12) United States Patent
Swart

(10) Patent No.: US 10,426,298 B2
(45) Date of Patent: Oct. 1, 2019

(54) CAPPED RIM SYSTEM FOR A BATHTUB

(71) Applicant: Kohler Co., Kohler, WI (US)

(72) Inventor: Peter W. Swart, Oostburg, WI (US)

(73) Assignee: KOHLER CO., Kohler, WI (US)

( * ) Notice: Subject to any disclaimer, the term of this patent is extended or adjusted under 35 U.S.C. 154(b) by 0 days.

(21) Appl. No.: 16/156,811

(22) Filed: Oct. 10, 2018

(65) Prior Publication Data

US 2019/0038081 A1 Feb. 7, 2019

Related U.S. Application Data

(63) Continuation of application No. 14/933,711, filed on Nov. 5, 2015, now Pat. No. 10,123,657.

(51) Int. Cl.

| | |
|---|---|
| ***A47K 3/00*** | (2006.01) |
| ***A47K 3/10*** | (2006.01) |
| ***A61H 33/00*** | (2006.01) |
| ***E04H 4/14*** | (2006.01) |
| ***A61H 23/02*** | (2006.01) |

(52) U.S. Cl.

CPC ..... *A47K 3/001* (2013.01); *A47K 3/10* (2013.01); *A61H 33/0087* (2013.01); *A61H 33/0095* (2013.01); *A61H 33/6005* (2013.01); *A61H 33/6063* (2013.01); *A61H 33/6084* (2013.01); *E04H 4/148* (2013.01); *A61H 23/02* (2013.01); *A61H 2033/0016* (2013.01); *A61H 2033/0058* (2013.01); *A61H 2033/0083* (2013.01); *A61H 2201/0188* (2013.01); *A61H 2201/0207* (2013.01); *A61H 2201/0228* (2013.01); *A61H 2201/0242* (2013.01); *A61H 2201/1207* (2013.01); *A61H 2201/1215* (2013.01); *A61H 2201/1633* (2013.01); *A61H 2201/50* (2013.01); *A61H 2201/5038* (2013.01); *A61H 2201/5043* (2013.01); *A61H 2201/5048* (2013.01); *E04H 4/141* (2013.01)

(58) Field of Classification Search

CPC ..... A47K 3/001; A47K 3/10; A61H 33/0087; A61H 33/0095; A61H 33/6005; A61H 33/6063; A61H 33/6084; E04H 4/148

USPC ..... 4/541.1, 541.3, 580, 591

See application file for complete search history.

(56) References Cited

U.S. PATENT DOCUMENTS

| | | | | |
|---|---|---|---|---|
| 493,194 | A | 3/1893 | Stifel et al. | |
| 1,047,400 | A | 12/1912 | Fischer | |
| 1,198,303 | A | 9/1916 | Williams | |
| 1,393,482 | A | 10/1921 | Abraham et al. | |
| 1,412,193 | A | 4/1922 | Neudeck | |
| 1,438,373 | A | 12/1922 | Gould | |
| 1,563,783 | A | 12/1925 | Paul | |
| 1,633,582 | A | 6/1927 | Gould | |
| 2,430,027 | A | 11/1947 | Morrison | |
| 2,679,652 | A | 6/1954 | Eyring | |
| 3,579,667 | A | 5/1971 | Giglio | |
| 4,575,882 | A * | 3/1986 | Diamond | A47K 3/001 4/559 |
| 4,868,934 | A | 9/1989 | Altman | |
| 5,127,111 | A | 7/1992 | Sieth | |
| 5,682,628 | A | 11/1997 | Oleson | |

(Continued)

*Primary Examiner* — Tuan N Nguyen

(74) *Attorney, Agent, or Firm* — Foley & Lardner LLP

(57) ABSTRACT

A bathtub includes a bathing well having a rim and an inner well defined in the rim. The bathtub further includes a rim cap disposed over the rim and an electronic component disposed in at least one of the inner well or the rim cap.

18 Claims, 3 Drawing Sheets

(56) References Cited

U.S. PATENT DOCUMENTS

| | | | | |
|---|---|---|---|---|
| 6,360,380 | B1 | 3/2002 | Swart et al. | |
| 6,463,598 | B1 | 10/2002 | David et al. | |
| 6,915,535 | B2 * | 7/2005 | Sieger | A47K 3/001 4/591 |
| 2012/0096637 | A1 * | 4/2012 | Laflamme | A61H 33/0087 4/559 |

* cited by examiner

CAPPED RIM SYSTEM FOR A BATHTUB

CROSS-REFERENCE TO RELATED PATENT APPLICATION

This application is a Continuation of U.S. patent application Ser. No. 14/933,711, filed Nov. 5, 2015, which is hereby incorporated by reference in its entirety.

FIELD

The present application relates generally to bathtubs, and more specifically, to bathtubs having a capped rim.

BACKGROUND

In general, bathtubs are formed by a bathing well having an integrated bath rim formed along the upper perimeter of the bathing well. The bathing well holds water that allows a bather to soak and wash during use of the bathtub. The bath rim, in some instances, may be designed solely for aesthetic purposes such that a decorative effect is provided to the bathtub. In other instances, the bath rim may be designed to serve a functional purpose, for example, to provide an alternative means for introducing water and/or a cleaning liquid into the bathing well.

In addition, in order to enhance the bathing experience, some bathtubs may be designed as whirlpool baths. Whirlpool baths typically include a bathing well connected to a branched piping system, which connects to a plurality of jets that allow for the recirculation of water back into the bathing well. The plurality of jets increase the flow of water over the bather's body, providing a relaxing and/or massaging effect to the bather. However, if a bather chooses to bathe with less than a full bath of water, there is typically no water being provided to the upper half portion of the bather's body as the plurality of jets are often located in the lower half of the bathing well. Thus, in some instances, the bather may have to substantially fill the bathing well with water in order to provide a means for keeping the upper half portion of the bather's body exposed to the warm water, which may lead to an increase in water consumption.

Accordingly, given the potential versatility in both the aesthetic and functional purposes of a bath rim, it would be advantageous to provide a bathtub having a bath rim that can be customized to a specific functional purpose according to an individual bather's needs, while still retaining the desired aesthetics of the bathtub. In addition, it would be advantageous to provide a bathtub that allows for an alternative, or an addition, to a whirlpool bath system. These and other advantageous features will become apparent to those reviewing the disclosure and drawings.

SUMMARY

The capped rim bathtub system of the present disclosure includes a bathtub having a bath rim that is capped by a rim cap. Such a system allows for embodiments where the bath rim may be customized into a variety of configurations, according to an individual bather's needs or preferences. For example, the bath rim may be formed in order to provide additional functionality to the bathtub system, such as allowing for the addition of a water recirculation system, storage space, and/or a means for housing various electronics. The rim cap may serve to cover the bath rim in order to allow the bath rim to be formed into the specific configuration needed for the bathtub system without detracting from the overall aesthetics of the bathtub. The rim cap may then itself be customized into a variety of shapes and materials in order to provide the desired decorative effects for the bathtub system.

One embodiment relates to a bathtub, including a bathing well having a rim and an inner well defined in the rim. The bathtub further includes a rim cap disposed over the rim and an electronic component disposed in at least one of the inner well or the rim cap.

Another embodiment relates to a capped bathtub system. The capped bathtub system comprises a bathing well having a rim extending along a perimeter of an upper part of the bathing well and a rim cap configured to cover the rim. The rim cap includes a first flange extending partially along an inner surface of the bathing well, a second flange extending partially along an outer surface of the bathing well, and a cover portion connecting the first flange to the second flange. At least one recess is formed into a portion of the rim that is covered by the rim cap.

Another embodiment relates to a system for recirculating water contained in a bathtub. The system for recirculating water comprises a bathtub having a bathing well, wherein the bathing well includes a rim extending along a perimeter of an upper part of the bathing well. The system for recirculating water also includes a rim cap configured to cover the rim. The rim cap includes a first flange extending partially along an inner surface of the bathing well, a second flange extending partially along an outer surface of the bathing well, and a cover portion connecting the first flange to the second flange. At least one well is formed into the rim, which is configured to receive water contained in the bathing well. At least one channel is also formed into the rim and is connected to the at least one well. The at least one channel is configured to supply the water contained in the well into the bathing well.

Yet another disclosed embodiment relates to a rim cap for a bathtub. The rim cap comprises a first flange configured to extend partially along an inner surface of a bathtub, a second flange configured to extend partially along an outer surface of the bathtub, and a cover portion connecting the first flange to the second flange, wherein the cover portion is configured to cover a rim of the bathtub.

DETAILED DESCRIPTION

Referring generally to the FIGURES, disclosed herein are bathtub systems that enable an enhanced washing experience.

Figure 1:
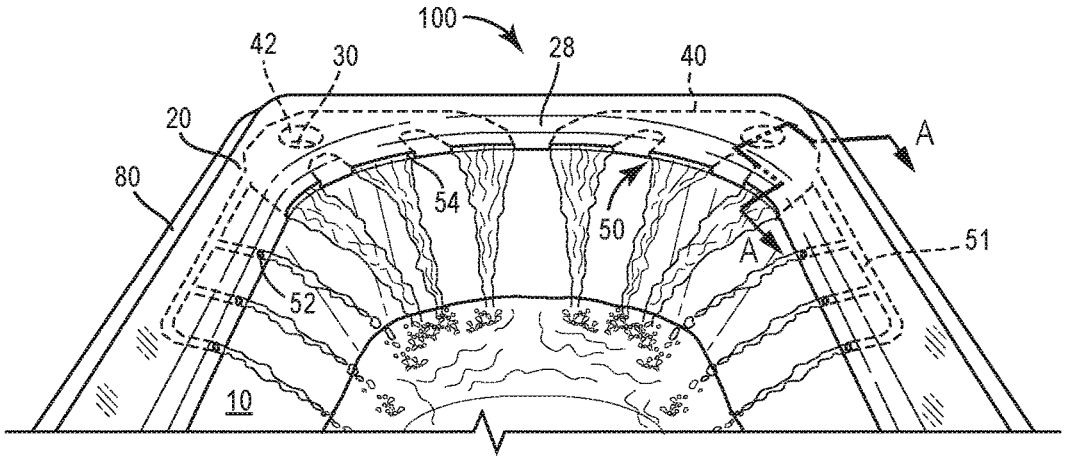
FIG. 1 is a perspective view of a bathtub with a capped rim system, according to a first embodiment.
Figure 2:
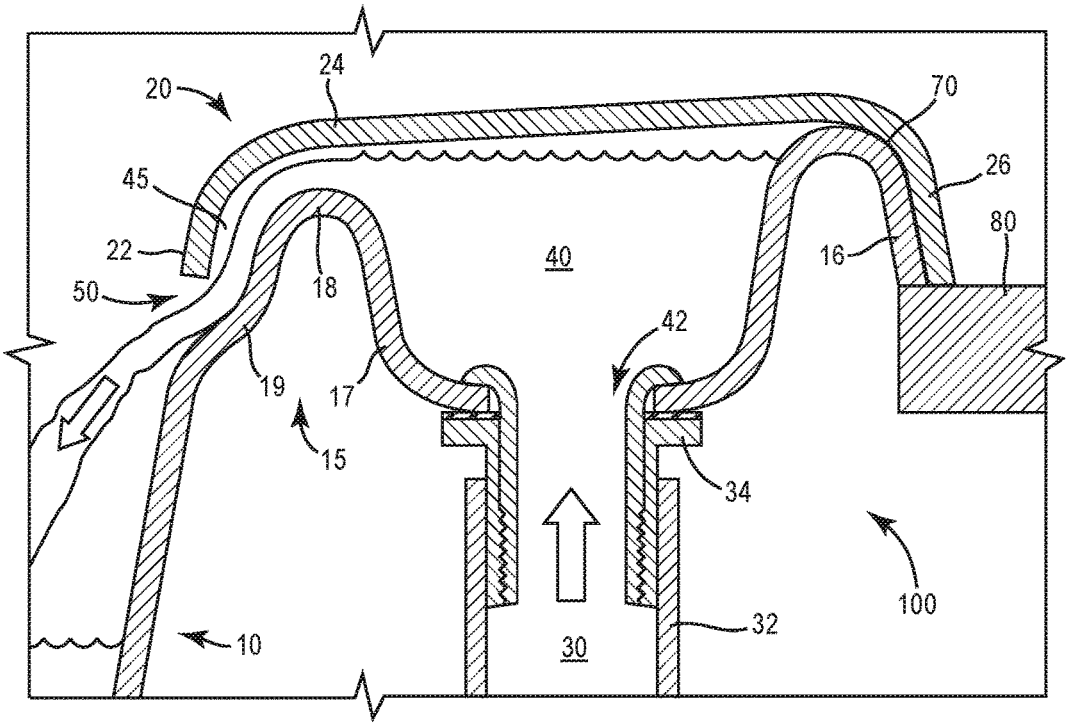
FIG. 2 is a section view taken along the A-A line of the bathtub with the capped rim system shown in FIG. 1.

According to an exemplary embodiment shown in FIG. 1, a bathtub having a capped rim system 100 is shown. The bathtub 100 includes a bathing well 10, which serves to hold the bather and the bathing water. The bathing well 10 includes a bath rim 15 (shown in FIG. 2) that is formed along the upper perimeter of the bathing well 10. The bathing well 10 is connected to a water supply using appropriate means to allow the supply of water into the bathing well 10 for bathing. As shown in FIGS. 1 and 2, a rim cap 20 is placed on top of the bath rim 15 and partially extends downward along the inner surface of the bathing well 10.

Referring now to FIG. 2, the bath rim 15 with the rim cap 20 is shown as a sectional view cut along the line A-A of FIG. 1. As shown in FIG. 2, the placement of the rim cap 20 allows the bath rim 15 to be shaped into any desired geometry that may suit the need of the particular bathtub 100. In one embodiment shown in FIG. 2, the bath rim 15 is shaped to house a water recirculation system that can recirculate bath water held in the bathing well 10 to flow over an upper portion of the bather's body, as will be described in more detail below.

As shown in FIG. 2, the bath rim 15 is molded (e.g., injection molded, casted, thermoformed) to include an inner well 40 formed by an inner well wall 17. The inner well wall 17 is generally bowl-like in shape with an aperture 42 formed at the bottom of the inner well wall 17. The aperture 42 leads to an inner channel 30 formed by a pipe 32, which is attached to the rim of the aperture 42 by an attachment member 34. The attachment member 34 may be any appropriate means for attaching the pipe 32 to the aperture 42, such as a bracket or a threaded pipe fitting. The inner channel 30 is connected to a pipe system (not shown) that is configured to receive water from an inlet hole (not shown) located in the lower portion of the bathing well 10. As will be described in more detail below, the inlet hole allows water in the bathing well 10 to be supplied into the inner channel 30 through the pipe system and recirculated back into the bathing well 10 using the recirculation system shown in FIG. 2.

Extending from the inner well wall 17 of the bath rim 15 is an outer flange 16 for connection to a supporting structure 80, such as a bathroom wall or the outer surface of the bathtub. Also extending from the inner well wall 17 on the inner side of the bathing well 10 is an overflow weir 18. In FIG. 2, the overflow weir 18 is shaped to extend to a height that is lower than the height of the outer flange 16 extending on the opposite side, allowing water that is contained in the inner well wall 17 to naturally flow over the overflow weir 18. The overflow weir 18 further extends into a curved guide portion 19, which connects to and is integrally formed with the bathing well 10.

As further illustrated in FIG. 2, the bath rim 15 is capped by a rim cap 20, which includes an inner flange 22, a cover portion 24, and an outer flange 26. The inner flange 22 of the rim cap 20 extends downward along the inner surface of the bath rim 15 and bathing well 10. As shown in FIG. 2, the inner flange 22 together with the curved guide portion 19 of the bath rim 15 form a channel 45, which, as will be described in more detail below, helps to direct water into the bathing well 10.

As shown in FIG. 2, the outer flange 26 of the rim cap 20 may serve as an attachment point for the rim cap 20 to the supporting structure 80. In addition, the outer flange 26 may serve as an attachment point for the rim cap 20 to the outer flange 16 of the bath rim 15. The outer flange 26 may be bonded (e.g., adhered, welded) to the bath rim 15 at an attachment area 70, such that the rim cap 20 remains capped on the bath rim 15 permanently. In addition, the rim cap 20 may be sealingly attached to the bath rim 15 to prevent the ingress and/or egress of water in the inner well 40 or to prevent contaminants from entering within the capped rim system. Furthermore, the rim cap 20 may also be attached to the bathing well 10 along the inner flange 22.

Alternatively, the outer flange 26 and/or inner flange 22 may be attached to the bathtub with appropriate fastening mechanisms, such as hinges or latches, allowing for the rim cap 20 to be removed from the bath rim 15. A removable rim cap 20 may allow for servicing and/or cleaning of any structures or devices contained within the inner well 40 or pipe 32 of the bath rim 15. In addition, a removable rim cap 20 may allow for easier installation or replacement of the rim cap 20 and any devices or structures contained within the capped rim system. Furthermore, the removable rim cap 20 may be configured to allow for a means of accessing any storage space contained within the bath rim 15.

The cover portion 24 of the rim cap 20 covers the inner geometry of the bath rim 15. As shown in FIG. 1, the cover portion 24 may include contours 28 to provide a decorative effect to the rim cap 10. In addition, the rim cap 10 may include other decorative effects including design patterns formed or applied onto the top surface of the cover portion 24, or additional cutouts and/or contours formed on the inner flange 22. In order to create the desired decorative features, the rim cap 10 may be manufactured using any desirable materials or any appropriate methods for forming. For example, the rim cap 20 may be thermoformed from plastics, such as acrylic and/or ABS, for ease of manufacturing and shaping. However, the material and form of the rim cap 20 is not particularly limited and may be made from any desired material or manufacturing method according to an individual's preference or need. For example, the rim cap 20 may be made from materials that include, but are not limited to, wood, stone, tile, glass, stainless steel, fabric-covered materials, or cast iron.

As detailed above, the bathtub with the capped rim system 100 is customizable, allowing for a variety of uses and bathing experiences. FIGS. 1 and 2 show an embodiment of the bathtub with the capped rim system 100 as utilized as a water recirculating system. In operation, a recirculating pump (not shown) pumps water from the inlet hole (not shown) located at a bottom portion of the bathing well 10. The water then flows up the inner channel 30 through the pipe 32 to fill the inner well 40. Once the inner well 40 is filled, water then flows over the overflow weir 18 into the channel 45. As shown in FIGS. 1 and 2, spouts 50 are formed into the inner flange 22 of the rim cap 20 to allow the water flowing from channel 45 to flow back into the bathing well 10 in discrete areas.

As further shown in FIG. 1, the bath rim 15 may be molded to include additional flow channels 51 to direct water flowing out from the inner well 40 to various zones or areas of the bathing well 10. The flow channels 51 may lead to the spouts 50 formed of various shapes such that different water flow patterns are produced. For example, the spouts 50 may be formed as elongated linear openings 52 to create a "falling-sheet" or waterfall effect. The spouts 50 may also be formed as small orifices 54 to produce a more focused, jet-like stream of water. The shape of the spouts 50 is not particularly limited and the spouts 50 may be shaped in any appropriate form to produce the desired flow effect. In addition, various types of spouts 50 may be used in combination (e.g., elongated linear openings 52 and small orifices 54 as illustrated in FIG. 1) to provide particular water flow patterns. For example, the spouts 50 may be formed and combined in order to produce a particular flow pattern that enhances therapeutic effects for the bather. The flow channels 51 and the spouts 50 may further include baffles and/or edge treatments to improve or enhance the flow of water into the bathing well 10. In addition, the curved guide portion 19 of the bath rim 15 may be further configured to allow water to flow through the channel 45 in such a way as to enhance the flow of water over the upper portion of the bather's body.

The water recirculation system may be connected to a user interface, such as a switch or control device, that allows the bather to turn the recirculation pump on or off in order to start or stop the flow of recirculated water through the system. In addition, the water recirculation system may include a heating device (e.g., heating wires) connected to the inner well 40. The heating device may be placed, for example, along the outer surface of the inner well wall 17 or may be embedded into the inner well wall 17. The heating device may be configured to provide continuous heat to the water contained in the inner well 40, such that the bather is provided with a heated water flow from the bath rim 15. Moreover, the water recirculation system may be alternatively used as an integral fill device. In other words, the water recirculation system can be configured to house water in the inner well 40 prior to use of the bathtub by the bather. Thus, when the bather first enters the bathing well 10 and attempts to supply water to fill the bathing well 10 for bathing, the water held in the inner well 40 may be used to provide an initial fill of water to the bathing well 10. This allows for a quicker and more efficient fill of the bathing well 10.

Because the water recirculation system shown in FIGS. 1 and 2 draws water from the bottom of the bathing well and returns on the water along the bath rim 15, the system allows for the flow of water over the upper portion of the bather's body even when the bathing well 10 is partially full. In some instances, the water recirculation system may allow water to be drawn from and flowed back into the bathing well 10 when only a third or less of the bathing well 10 is filled with water. This allows for the bather to be fully bathed in warm water while decreasing the need for additional water consumption. Moreover, such a system may allow for a whirlpool bath-like experience without the use of a typical whirlpool bath system, which may eliminate the need for additional piping and whirlpool jets. Alternatively, the recirculation system may be used in conjunction with a traditional whirlpool system in order to provide additional options and water flow experiences to the bather.

While the bathtub with a capped rim system 100 is shown as utilized as a water recirculation system, the system illustrated in FIGS. 1 and 2 is not limited to such use. For instance, the water recirculation system shown in FIGS. 1 and 2 may also be used as a cleaning system. For example, the inner well 40 may be configured to house cleaning liquids and, when a bather has finished bathing, the water contained in the bathing well 10 is recirculated through the inner well 40 before being completely drained from the bathing well 10. The water that enters the inner well 40 mixes with the cleaning liquids housed in the inner well 40 and is then re-distributed along the bath rim 15 to clean the bathing well 10 for its next use.

Figure 3:
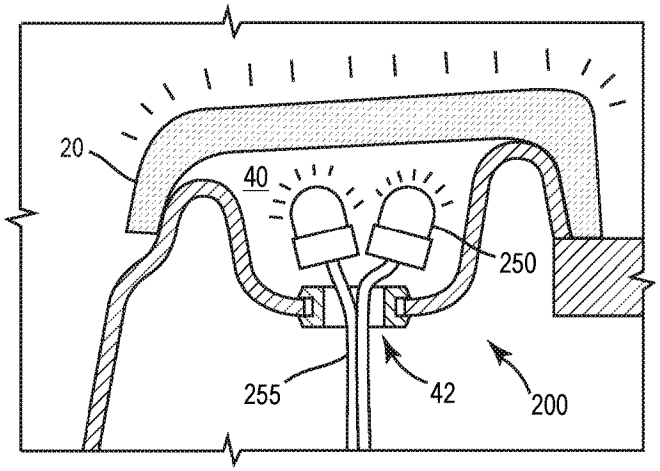
FIG. 3 is a section view of a bathtub with a capped rim system, according to a second embodiment.

In addition, apart from being used as a recirculation system, the bathtub with capped rim system may further be used to house various electronics, such as lighting systems and/or audio equipment, in order to provide various visual and/or auditory effects during bathing. For example, as shown in FIG. 3, a bathtub with a capped rim system 200 may include one or more lighting elements 250, such as LED lights or the like, placed in the inner well 40. Wiring 255 connected to the lighting elements 250 may extend through the inner channel 30 for electrical connection to the outside of the bathtub system 200. In this configuration, the capped rim 20 may help to serve as a protective barrier of the electronics from the water contained in the bathtub system 200. Moreover, in this configuration, the capped rim 20 may be also formed from transparent or semi-transparent materials in order to allow the light emitted from the lighting elements 250 to be viewed by the bather through the rim cap 20, which may increase the aesthetic effect of the bathtub.

Figure 4:
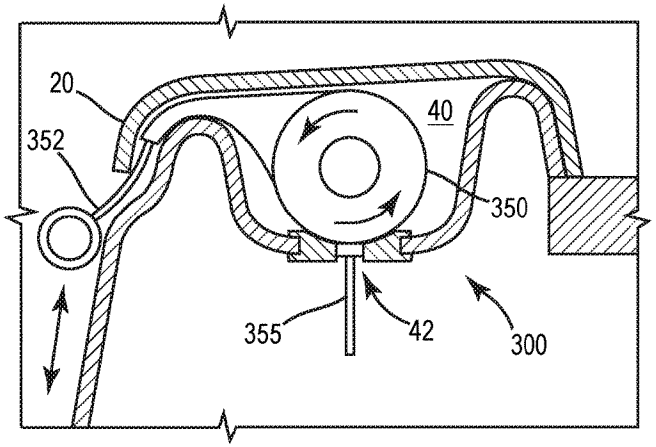
FIG. 4 is a section view of a bathtub with a capped rim system, according to a third embodiment.

The inner well 40 may also be used to house various motors and/or actuators. For example, as shown in FIG. 4, a bathtub with a capped rim system 300 may include a rotary motor 350 placed in the inner well 40. The rotary motor 350 may be connected to a lifting mechanism 352, such as a cable, contained in the bathing well 10, which may be further connected to a seat (not shown) for assisting the bather to enter and exit the bathing well 10 or to provide adjustable seating in the bathing well 10. Similar to the lighting system described above, the motor 350 may be electrically connected to the outside of the bathtub system 300 via wiring 355, which extends through the aperture 42. The motor 350 may be further controlled by the bather through a user interface, such as a switch or control device, to adjust the seat to a desirable level.

Figure 5:
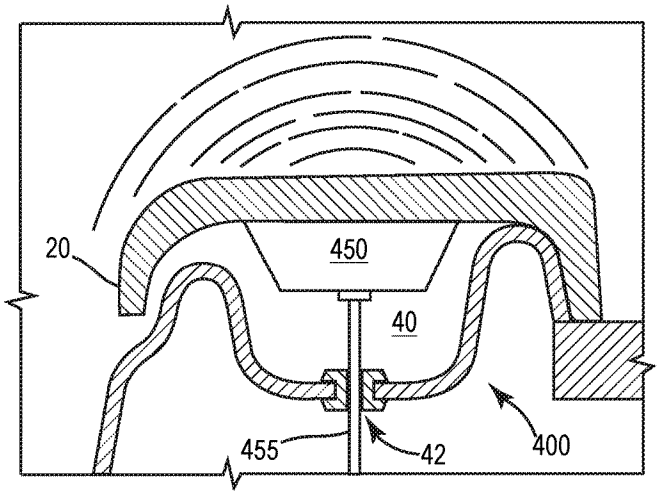
FIG. 5 is a section view of a bathtub with a capped rim system, according to a fourth embodiment.

In addition, as shown in FIG. 5, a bathtub with a capped rim system 400 may include a vibration motor 450 placed in the inner well 40. The vibration motor 450 may be positioned just below the rim cap 20 and may be electrically connected to the outside of the bathtub system 400 via wiring 455, which extends through the aperture 42. When operated, the vibration motor 450 may vibrate the rim cap 20, which may impart a massaging effect to the bather during bathing. The vibration motor 450 may also be controlled by the bather through a user interface, such as switch or control device, to turn the vibrating effect on or off, or to adjust the intensity of the vibrating effect for varying massage-like experiences.

Figure 6:
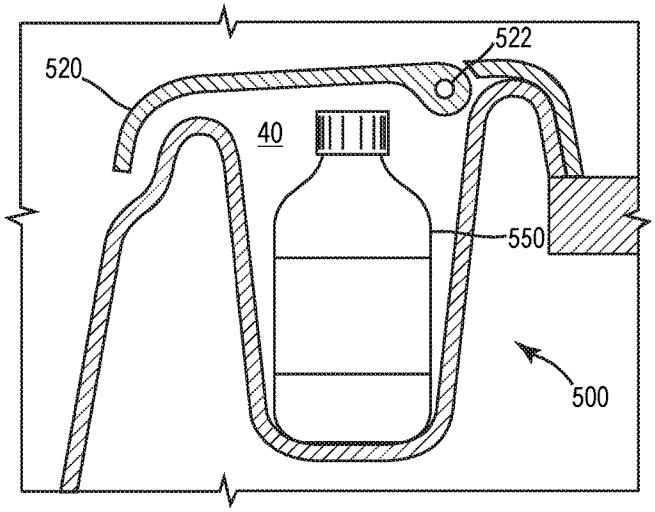
FIG. 6 is a section view of a bathtub with a capped rim system, according to a fifth embodiment.

Other additional configurations may be incorporated into the bathtub with a capped rim system for added functionality, such as those shown in FIGS. 6-9. For example, as shown in FIG. 6, a bathtub with a capped rim system 500 may include an inner well 40 that is configured to store various supplies and/or equipment 550. The rim cap 520 may be configured such that the bather may easily access the storage space. For example, as shown in FIG. 6, the rim cap 520 may include a hinge portion 522, allowing the bather to lift the rim cap 520 away from the bathing well 10 in order to access supplies contained within the inner well 40. The rim cap 520 is not limited to the use of a hinge portion 522 and may include any appropriate connection mechanism that allows the bather to lift the rim cap 520 away from the bathing well 10 for access to the inner well, such as, for example, magnets or the like, for temporary locking of the rim until access to the inner well 40 is needed. In addition, the inner well 40 may be shaped to provide additional storage space for the bather according to the bather's need. Shelves and/or recesses may be integrated into the inner well 40 such that the bather can store and organize various bathroom supplies or other items in the inner well 40. Thus, the bather is provided with additional storage space for bathroom supplies or other items, while still retaining the desired aesthetics of the bathtub.

Figure 7:
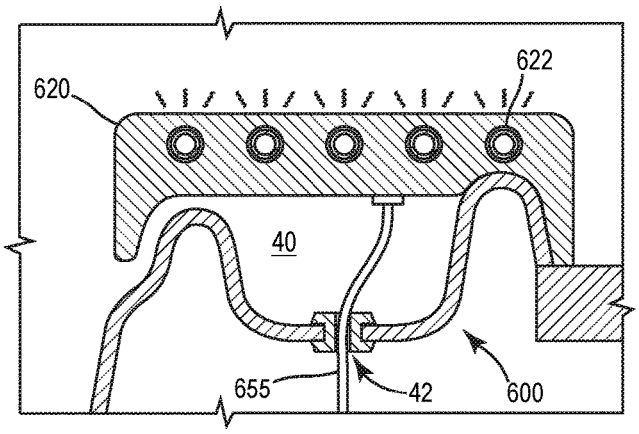
FIG. 7 is a section view of a bathtub with a capped rim system, according to a sixth embodiment.

In addition, as shown in FIG. 7, a bathtub with a capped rim system 600 may include a rim cap 620 that is configured to be heated. The rim cap 620 may include integrated heating wires 622, may be electrically connected to the outside of the bathtub system 600 via wiring 655, which extends through the aperture 42. The integrated heating wires 622 may heat the rim cap 620, which may be formed of any appropriate material capable of integrally housing the heating wires 622, such as, for example, ceramics, plastics, or the like. The heating system may be controlled by the bather by a user interface in order to allow the bather to set a desired heating level. Such a bathtub system 600 allows the bather to experience additional heat to the upper part of the bather's body during the bathing experience without the addition of water to the bathing well.

Figure 8:
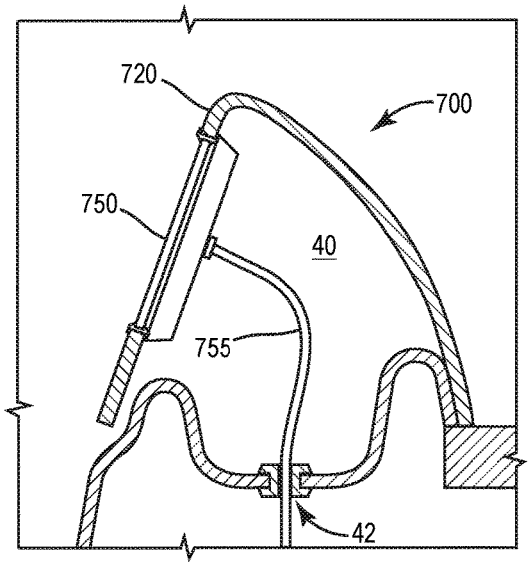
FIG. 8 is a section view of a bathtub with a capped rim system, according to a seventh embodiment.
Figure 9:
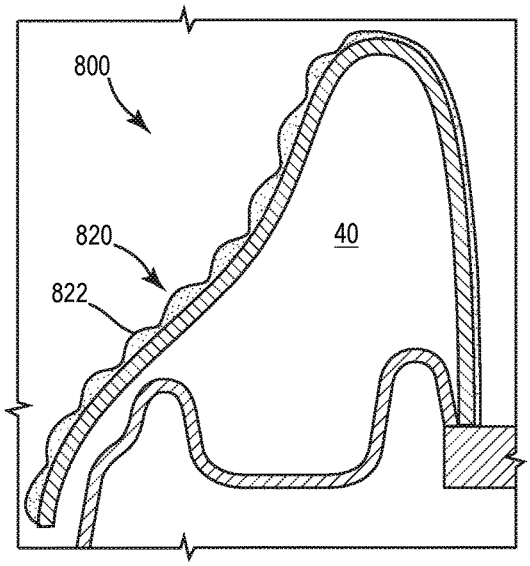
FIG. 9 is a section view of a bathtub with a capped rim system, according to an eighth embodiment.

Moreover, the geometry of the rim cap is not limited to the shape shown in FIG. 2-7. For example, as shown in FIGS. 8 and 9, the rim cap may include any appropriate shape, such as an inclined inner face. As shown in FIG. 8, a bathtub with a capped rim system 700 includes a rim cap 720 that is configured to house auditory or visual equipment 750, such as a speaker or a display unit (e.g., a television screen). Alternatively, the rim cap 720 may be configured to house other forms of visual displays, such as a mirror, graphic designs, artwork and/or pictures. The rim cap 720 may be inclined at an angle such that the bather may easily view and/or hear the equipment 750 located within the rim cap 720 during bathing. Such a bathtub system 700 may further enhance the bathing experience by providing the bather with additional entertainment as desired. In addition, as shown in FIG. 9, a bathtub with a capped rim system 800 may include a rim cap 820 that is inclined at an angle and ergonomically shaped such that the bather may easily rest a portion of his upper body on the rim cap 820 during bathing for comfort purposes. The rim cap 820 may be further lined with a soft, deformable material 822, such as, for example, a foam-based material, in order to provide additional comfort and a massaging effect to the bather while resting on the rim cap 820.

All of the systems described herein may be used alone or in combination. For example, the bath rim may be molded in certain areas to provide a water recirculation system and include a storage space, such as that shown in FIG. 6, in other areas. In addition, a lighting system, as shown in FIG. 3, may be integrated in the inner well together with the water recirculation system. Such a configuration may allow for a lighted waterfall effect as water flows back into the bathing well. The bathtub system including the rim cap disclosed herein enables a customizable bathing experience and allows for the integration of a variety of components into the bath rim, which can provide added functionality to the bathtub according to the bather's preferences and needs. In addition, by including a rim cap to the bathtub system disclosed herein, not only can the bathtub system be provided with a near limitless combination of added functionalities through the formation of the bath rim, the bathtub further allows for a customizable aesthetic design to suit the preferences of the particular individual through the formation of the rim cap. Thus, a customizable bathing experience in both form and function may be achieved.

One disclosed embodiment relates to a capped bathtub system. The capped bathtub system comprises a bathing well having a rim extending along a perimeter of an upper part of the bathing well and a rim cap configured to cover the rim. The rim cap includes a first flange extending partially along an inner surface of the bathing well, a second flange extending partially along an outer surface of the bathing well, and a cover portion connecting the first flange to the second flange. At least one recess is formed into a portion of the rim that is covered by the rim cap.

Another disclosed embodiment relates to a system for recirculating water contained in a bathtub. The system for recirculating water comprises a bathtub having a bathing well, wherein the bathing well includes a rim extending along a perimeter of an upper part of the bathing well. The system for recirculating water also includes a rim cap configured to cover the rim. The rim cap includes a first flange extending partially along an inner surface of the bathing well, a second flange extending partially along an outer surface of the bathing well, and a cover portion connecting the first flange to the second flange. At least one well is formed into the rim, which is configured to receive water contained in the bathing well. At least one channel is also formed into the rim and is connected to the at least one well. The at least one channel is configured to supply the water contained in the well into the bathing well.

Yet another disclosed embodiment relates to a rim cap for a bathtub. The rim cap comprises a first flange configured to extend partially along an inner surface of a bathtub, a second flange configured to extend partially along an outer surface of the bathtub, and a cover portion connecting the first flange to the second flange, wherein the cover portion is configured to cover a rim of the bathtub.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

It is important to note that the construction and arrangement of the various exemplary embodiments are illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. Other substitutions, modifications, changes and omissions may also be made in the design, operating conditions and arrangement of the various exemplary embodiments without departing from the scope of the present invention.

What is claimed is:

1. A bathtub comprising:

a bathing well comprising an inner surface, a supporting structure, and a rim, the rim having a rim inner flange extending from the inner surface to an inner well wall and a rim outer flange extending from the inner well wall to the supporting structure, the rim defining an inner well between the rim inner flange, the inner well wall, and the rim outer flange;

a rim cap having a rim cap inner flange disposed over the rim inner flange and a rim cap outer flange disposed over the rim outer flange; and an electronic component disposed in at least one of the inner well or the rim cap.

2. The bathtub of claim 1, further comprising an aperture extending through the inner well wall, the aperture configured to receive a wire therethrough.

3. The bathtub of claim 2, wherein the wire is coupled to the electronic component and extends externally from the bathtub.

4. The bathtub of claim 1, wherein the electronic component comprises a heating system.

5. The bathtub of claim 4, wherein the heating system comprises at least one heating wire.

6. The bathtub of claim 5, wherein the at least one heating wire is integrally formed in the rim cap.

7. The bathtub of claim 4, wherein the heating system is disposed on the inner well wall.

8. The bathtub of claim 1, wherein the rim cap sealingly engages the rim, such that the inner well is sealed from the bathing well.

9. The bathtub of claim 8, wherein the rim cap is configured to prevent water from entering the inner well.

10. The bathtub of claim 1, wherein the rim is disposed at an upper periphery of the bathing well.

11. The bathtub of claim 10, wherein the supporting structure is one of a bathroom wall or an outer surface of the bathtub.

12. The bathtub of claim 1, wherein the rim cap is removably coupled to the rim.

13. The bathtub of claim 1, wherein the rim cap is transparent or semi-transparent and configured to emit light from the inner well through the rim cap.

14. The bathtub of claim 1, wherein the rim inner flange and the rim outer flange are integrally formed with the inner well wall.

15. The bathtub of claim 1, wherein the rim cap inner flange is integrally formed with the rim cap outer flange.

16. A bathtub comprising:

a bathing well comprising a rim and an inner well defined in the rim;

a rim cap disposed over the rim; and a heating wire disposed in at least one of the inner well or the rim cap; wherein:

the bathing well further comprises an inner surface and a supporting structure;

the rim comprises a rim inner flange extending from the inner surface to an inner well wall and a rim outer flange extending from the inner well wall to the supporting structure, the rim defining the inner well between the rim inner flange, the inner well wall, and the rim outer flange; and the rim cap comprises a rim cap inner flange disposed over the rim inner flange and a rim cap outer flange disposed over the rim outer flange.

17. The bathtub of claim 16, wherein the rim inner flange and the rim outer flange are integrally formed with the inner well wall.

18. The bathtub of claim 16, wherein the rim cap inner flange is integrally formed with the rim cap outer flange.

* * * * *